US005876188A

United States Patent [19]

Okamoto

[11] Patent Number: 5,876,188

[45] Date of Patent: Mar. 2, 1999

[54] OIL PUMP ARRANGEMENT FOR FOUR-CYCLE OUTBOARD MOTOR

[75] Inventor: Yutaka Okamoto, Hamamatsu, Japan

[73] Assignee: Sanshin Koguo Kabushiki Kaisha, Hamamatsu, Japan

[21] Appl. No.: 741,525

[22] Filed: Oct. 31, 1996

[30] Foreign Application Priority Data

Oct. 31, 1995 [JP] Japan ..... 7-283548

[51] Int. Cl.[6] ..... F04B 17/06

[52] U.S. Cl. ..... 417/364; 440/88; 184/6.18

[58] Field of Search ..... 417/364; 440/900, 440/88; 189/6.18

[56] References Cited

U.S. PATENT DOCUMENTS

| | | | |
|---|---|---|---|
| 2,246,206 | 6/1941 | Herrington | 115/18 |
| 2,346,148 | 4/1944 | Bosma | 184/6 |
| 2,493,148 | 1/1950 | Kiekhaefer | 103/132 |
| 3,645,360 | 2/1972 | Holtermann | 184/6.18 |
| 4,523,556 | 6/1985 | Suzuki | 123/196 W |
| 4,828,519 | 5/1989 | Watanabe | 440/88 |
| 4,911,119 | 3/1990 | Ohno et al. | 123/196 W |
| 5,215,164 | 6/1993 | Shibata | 184/6.13 |
| 5,236,380 | 8/1993 | Schueller et al. | 440/76 |
| 5,271,723 | 12/1993 | Hodge | 417/364 |
| 5,309,877 | 5/1994 | Shigedomi et al. | 123/19.5 P |
| 5,421,298 | 6/1995 | Ming et al. | 123/193.5 |
| 5,613,470 | 3/1997 | Shiomi et al. | 123/195 P |
| 5,687,688 | 11/1997 | Tsunoda et al. | 123/196 W |
| 5,755,606 | 5/1998 | Takahashi et al. | 440/84 |

FOREIGN PATENT DOCUMENTS 831451 3/1960 United Kingdom .

*Primary Examiner*—Timothy S. Thorpe
*Assistant Examiner*—Ehud Gartenberg
*Attorney, Agent, or Firm*—Knobbe, Martens, Olson & Bear LLP

[57] ABSTRACT

An oil pump for an engine of an outboard motor of the type including a block with an output shaft extending therefrom is disclosed. The oil pump includes an oil pan comprising an outer housing defining an oil chamber and a pumping chamber therein. The oil pump includes a pumping mechanism for pumping oil from the oil chamber to the engine. The pumping mechanism is positioned within the pumping chamber, with the outer housing defining the pumping chamber acting as a pump housing therefor. The pumping mechanism is positioned on and driven by the output shaft of the engine which extends through the oil and pumping chambers of the oil pan. A recess in the pumping chamber accomodates a flywheel, which is also positioned on and driven by the output shaft of the engine.

14 Claims, 4 Drawing Sheets

OIL PUMP ARRANGEMENT FOR FOUR-CYCLE OUTBOARD MOTOR

FIELD OF THE INVENTION

The present invention relates to an oil pump. More particularly, the present invention is an oil pump for providing lubricating oil to a four-cycle engine of an outboard motor.

BACKGROUND OF THE INVENTION

Outboard motors are powered by engines which are positioned within a cowling. The engine includes an output shaft which extends therefrom. The engine is oriented such that the output shaft extends downwardly to a lower drive section of the outboard motor for driving a propeller.

These engines include a lubricating system for delivering lubricating oil throughout the engine. Typical engine lubrication systems include a pump for delivering oil through oil delivery lines to various parts of the engine. Oil returns by gravity to an oil sump, from which it is drawn by the pump and returned to the engine.

In situations where the engine is oriented such that its output shaft extends horizontally, as compared to vertically, the oil sump is conveniently positioned below the engine block in a plane generally parallel to the output shaft. Oil flows downwardly through the engine to the sump, and the pump pumps the oil back up into the engine.

Orientation of the engines in outboard motors such that their output shafts extend vertically downward complicates the positioning of the oil sump. If the oil sump is connected to the engine block as described above, when the engine is rotated such that its output shaft extends vertically, the oil sump becomes oriented along the side of the engine in a vertical plane. This orientation is generally impermissible, since the oil will not drain back into the sump from the engine via gravity. In addition, it is generally desirable to limit the size of the outboard motor, especially in the horizontal direction. When the oil sump is positioned along the side of the engine, the engine's size in the horizontal direction is increased.

So that the oil will drain from the engine back to the oil sump by gravity, and to limit the engine's outward dimension, the oil sumps of engines powering outboard motors generally comprise chambers positioned below the end of the engine within the lower drive portion of the motor cowling. As the output shaft extends vertically downward in the same area in which it is desirable to position the oil sump, the oil sump often comprises a relatively narrow, but elongate chamber positioned alongside the output shaft. Because the oil pump inlet is positioned at the bottom of the sump, sump designs which have their ends far below the engine have the disadvantage that the oil pump must pump the oil a great distance upwardly into the engine, drawing greater engine power and/or generally lowering the oil pressure within the engine.

Another problem generally associated with these oil pumps is that the pumping or working elements thereof are positioned in a pump housing. The entire pump is then normally positioned within another portion of the engine, such as within the oil sump itself. This makes it difficult to service the oil pump, as the oil pump must first be located and then the outer housing thereof must be removed.

It is, therefore, an object of the present invention to provide an improved oil pump. It is a further object of the invention to provide an oil pump for the engine of an outboard motor wherein the oil pump is positioned close to the engine. It is yet a further object of the invention to provide an oil pump which is readily serviceable.

SUMMARY OF THE INVENTION

The present invention is an oil pump for the engine of an outboard motor which overcomes the above-stated limitations of pumps of the prior art. In general, the oil pump comprises an oil pan and means for pumping oil to the engine from the pan. The oil pump is adapted for use with the engine of an outboard motor which includes a block having an output shaft extending downwardly therefrom, and a flywheel positioned on the output shaft.

The oil pan comprises an outer housing defining an oil chamber and pumping chamber therein. Means for pumping are positioned in and cooperate with the pumping chamber to pump lubricating oil from the oil chamber to the engine. The output shaft of the engine passes through the oil and pumping chambers of the oil pan, and the means for pumping is driven by the output shaft.

As a further aspect of the present invention, the oil pan preferably includes a chamber for housing the flywheel of the engine, whereby the oil pump may be positioned at the bottom of the engine.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
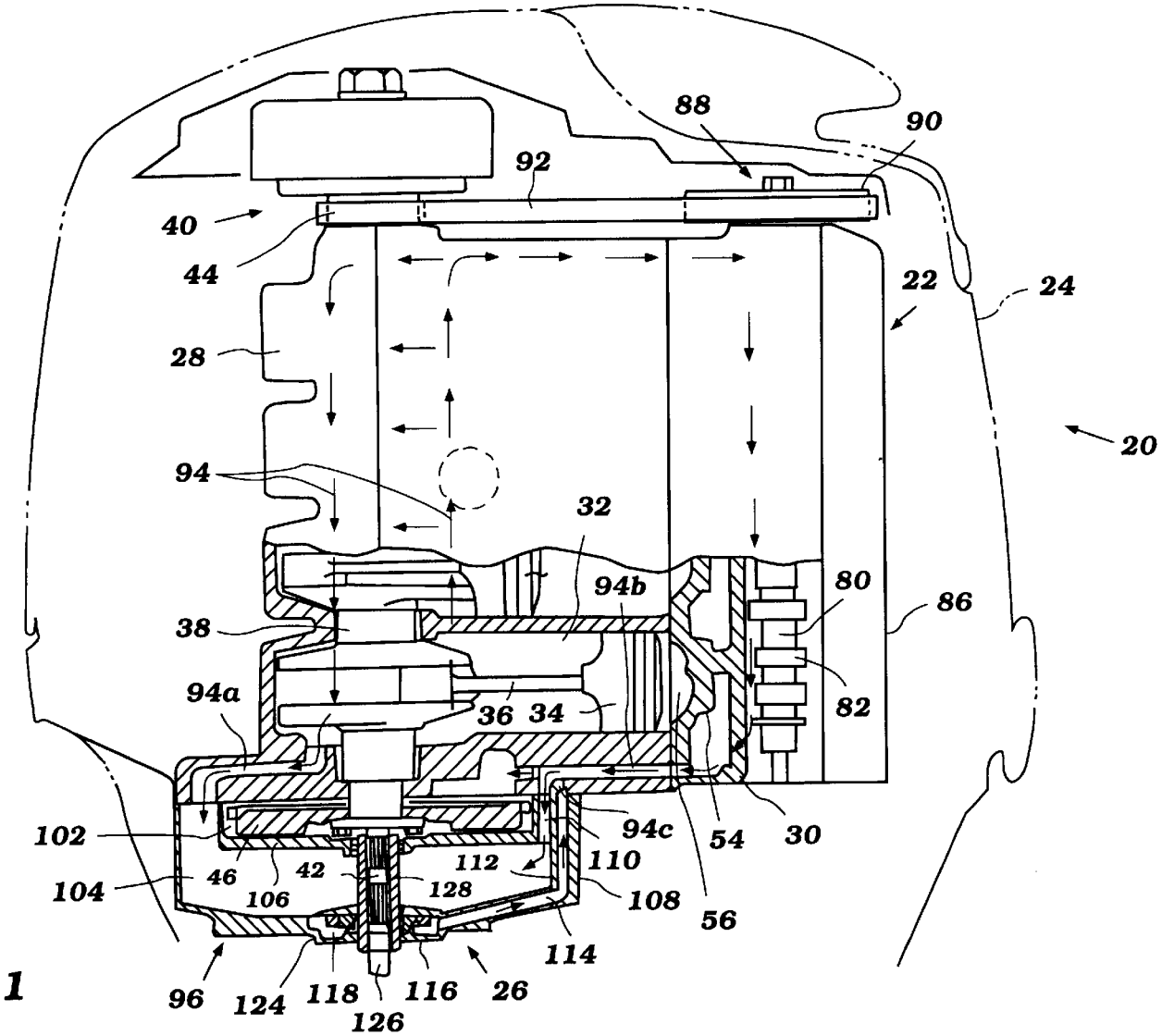
FIG. 1 illustrates, in partial cross-section, an outboard motor having an engine with an oil pump in accordance with the present invention.
Figure 2:
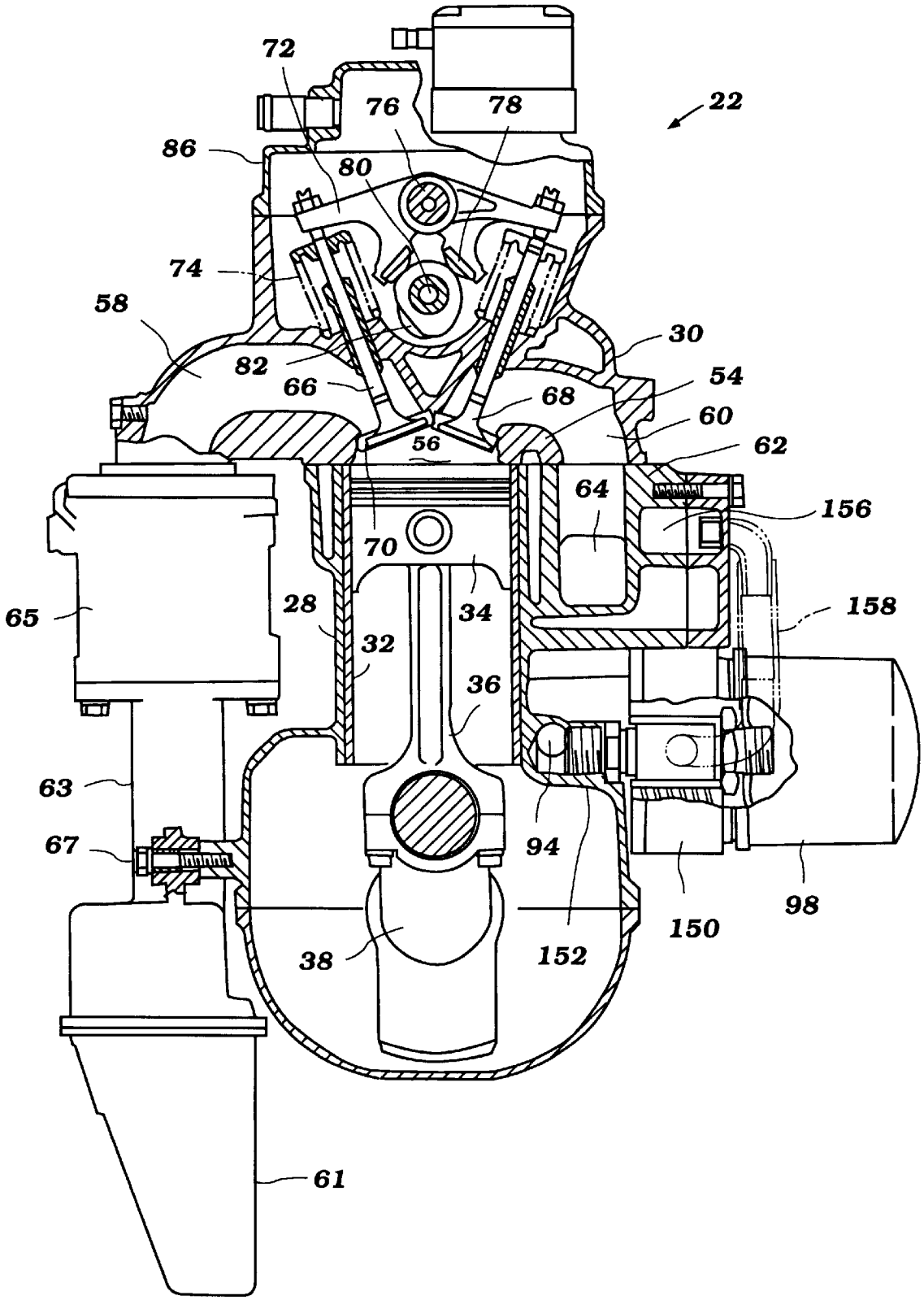
FIG. 2 is an end view of the engine illustrated in FIG. 1, shown in partial cross-section, the engine including a first configuration oil cooler and oil filter.
Figure 3:
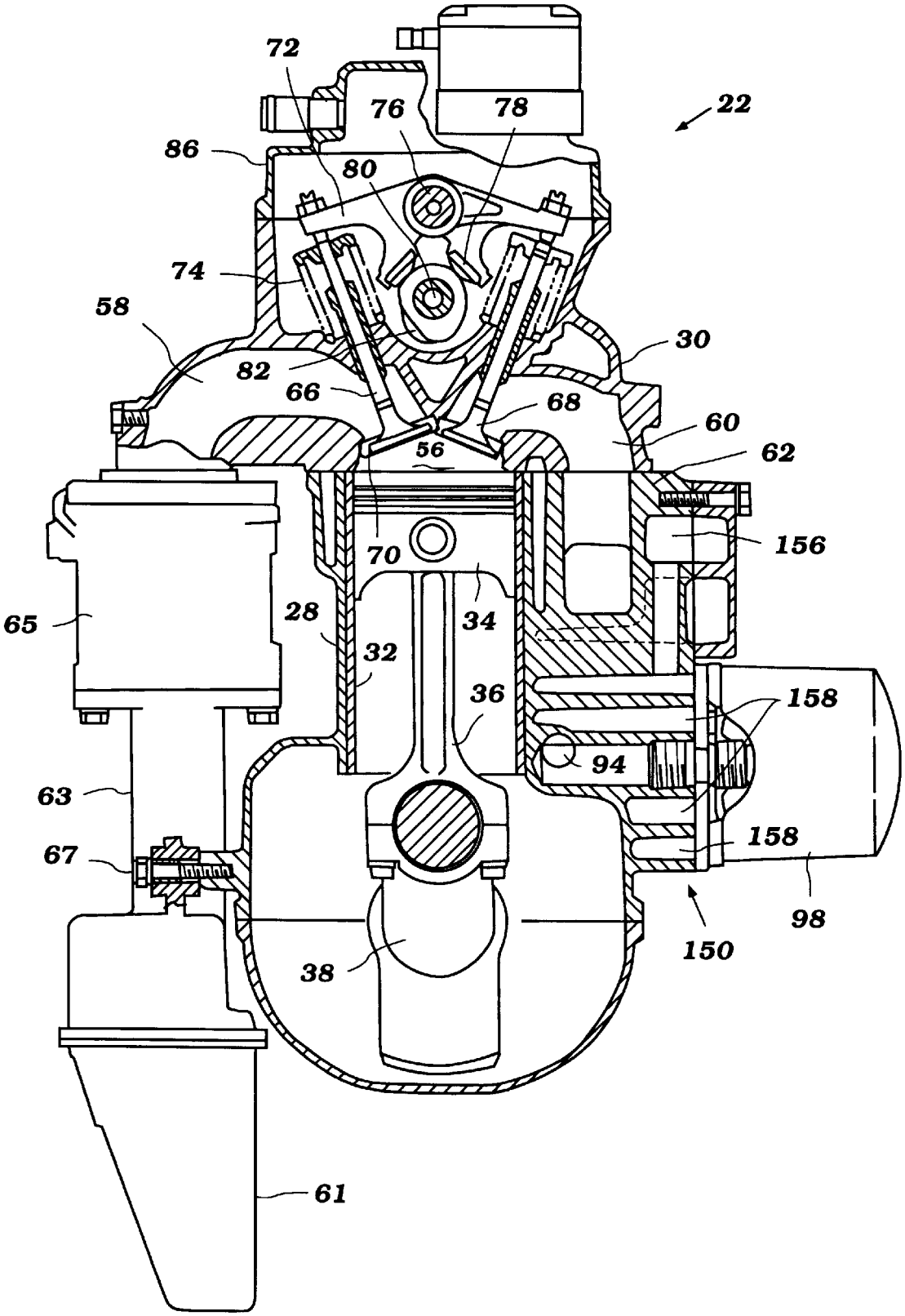
FIG. 3 is an end view of the engine illustrated in FIG. 1, shown in partial cross-section, the engine including a second configuration oil cooler and oil filter.

FIGS. 1–3 illustrate an outboard motor 20 having an engine 22 mounted within a cowling 24. The engine 22 includes an oil pump 26 in accordance with the present invention. The cowling 24 of the motor 20 surrounds and encloses the engine 22. The outboard motor 20 is preferably of the type which is utilized to a power a boat. When so utilized, the motor 20 is connected to the boat. Normally, the motor 20 is connected to the boat with a swivel for adjusting the trim, as is well known to those skilled in the art.

The engine 22 is preferably of the four-cycle variety, and has four cylinders mounted inline. It will be apparent to those skilled in the art how the invention may be employed with engines having other numbers of cylinders or cylinders arranged in other orientations, such as opposing or "V" configurations. It will also be apparent to those skilled in the art certain aspects of the invention may also be employed with engines having other types of variable volume combustion chambers, such as rotary or other ported type engines.

The engine 22 includes an engine block 28 having a cylinder head 30 connected thereto. As illustrated in FIG. 1, the engine block 28 contains four cylinders 32.

Reciprocally mounted in each cylinder 32 is a piston 34. Each piston 34 is connected via a connecting rod 36 to a crankshaft 38. The crankshaft 38 is mounted transversely to the direction of piston 34 movement. The crankshaft 38 has a first end 40 and a second end 42 which are journalled for rotation with respect to the engine block 28. The engine 22 drives an output for driving a propulsion element or the like. Preferably, the output comprises a shaft, and more particularly comprises the crankshaft 38 coupled to a drive shaft 148 by a sleeve 128, as described in more detail below. In this arrangement, the second end 42 of the crankshaft 38 extends outwardly of the top end of the block 28 by a short distance.

A timing pulley 44 is connected to the first end 40 of the crankshaft 38, the pulley positioned outside of the engine block 28. A flywheel 46 is connected to output shaft of the engine 22, and more particularly that end of the crankshaft 38 extending outwardly of the block, and as such is positioned outside of the engine block 28. The flywheel 46 is preferably coupled to the output shaft via a mounting flange 48. First and second bolts 50, 52 connect the flywheel 46 to the flange 48.

The cylinder head 30 is connected to the engine block 28 above the open end of the cylinders 32 opposite the crankshaft 38. The cylinder head 30 includes a recessed portion 54 corresponding to each cylinder 32 for forming a combustion chamber 56 therewith.

As best illustrated in FIGS. 2 and 3, at least one intake passage 58 extends through the cylinder head 22 to the combustion chamber 56 of each cylinder. This intake passage 58 is in communication with an air intake 61.

The air intake 61 has an opening therein (not shown) for drawing outside air into the engine 22. The air is drawn upwardly from the intake 61 through an inlet plenum 63. The plenum 63 has an outwardly extending flange at one end for connection to a charge former 65, which will be described in more detail below. The air intake 62 and plenum 63 are preferably secured to the engine block 28 via a threaded bolt 67.

As also illustrated therein, at least one exhaust passage 60 extends from the combustion chamber 56 through the cylinder head 22. An exhaust manifold 62, formed integrally with the engine block 22, includes an exhaust passage 64 therethrough for routing exhaust gases from the engine 22.

An intake valve 66 is positioned in each intake passage 58 at the combustion chamber 56. Similarly, an exhaust valve 68 is positioned in each exhaust passage 60 at the combustion chamber 56. Each valve 66,68 has an enlarged portion which, when the valve 66,68 is in its closed position, engages a valve seat 70 and obscures the passage 58,60. Each valve 66,68 also has an elongate stem extending therefrom through a valve guide to a rocker arm 72. A spring 74 is mounted to each valve 66,68 for biasing the valve 66,68 into its closed position.

Each rocker arm 72 is rotatably mounted to a support shaft 76. The rocker arms 72 have a downwardly extending follower 78 for engaging a camshaft 80. The camshaft 80 is journalled for rotation with respect to the cylinder head 30, and extends generally parallel to the crankshaft 38. The camshaft 80 has a number of camming surfaces 82 there along for independently actuating each rocker arm 72 and opening the valves 66,68 corresponding thereto.

The camshaft 80 has a first end 88 which extends beyond the cylinder head 30. A camshaft drive pulley 90 is mounted to the first end 88 of the camshaft 80. A belt 92 extends between the first pulley 44 and the camshaft drive pulley 90, whereby the camshaft 80 is rotatably driven by the crankshaft 38. A cylinder head cover 86 is connected in sealing fashion to the cylinder head 30. The cover 86 extends over the camshaft 80 and rocker arms 72.

Fuel is supplied to the incoming air charge in the charge former 66. Fuel is routed from a fuel tank (not shown) through a fuel line (not shown) to the charge former 66 by a fuel pump (also not shown). Fuel for combustion is introduced into the incoming air charge within the charge former 66. Details of the fuel system are not provided herein, as such as well known to those skilled in the art.

The engine includes a lubrication system comprising a number of oil passages 94, and the oil pump 26 of the present invention. The oil passage 94 are of the type well known in the art for circulation lubricating oil throughout the engine 22. As illustrated in FIG. 1, oil passages 94 are provided for circulating oil from the pump 26 to the crankshaft 38, crankshaft bearings 38, pistons 34, camshaft 80 and rocker arms 72. Oil passages 94 may be provided through the crankshaft 38 for lubricating the bearings for the connecting rods 36 and the like. Those skilled in the art will readily appreciate the number and type of lubrication oil passages 94 which may be provided for distributing oil throughout the engine 22.

As best illustrated in FIGS. 2 and 3, an oil filter 98 is provided for filtering the lubricating oil. An oil cooler 150 is also provided for cooling the oil.

In FIG. 2, the oil cooler 150 is illustrated as of the external type. In this arrangement, the oil cooler 150 comprises a jacket which surrounds an oil line 152. The oil line 152 has a first end which is threaded for engagement with threads positioned in the engine block 28. When so engaged, the passage through the oil line 152 is in communication with a main oil delivery passage 94 within the engine 22. The filter element 98 is connected to the oil line 152. Oil from the pump 26 is filtered through the filter element 98.

Coolant, namely cooling water passing through the engine 22, is drawn through a pipe 154. The pipe 154 extends from a cooling water passage 156 in the block 28 of the engine 22 to the cooling jacket.

FIG. 3 illustrates a second embodiment oil filtering and cooling arrangement for use in the lubrication system of an engine 22 having the oil pump 26, as disclosed below. In this embodiment, the oil cooler 150 comprises a number of passages 158 formed in the engine block 28 and in communication with a cooling water passage 156 of the engine 22.

Oil to be filtered passes through one of the oil passages 94 to a filter passage 160. The filter element 98 is connected to the engine block 22 in communication with the filter passage 160. As illustrated, the filter passage 160 extends between the passages 158 of the cooling jacket.

Figure 4:
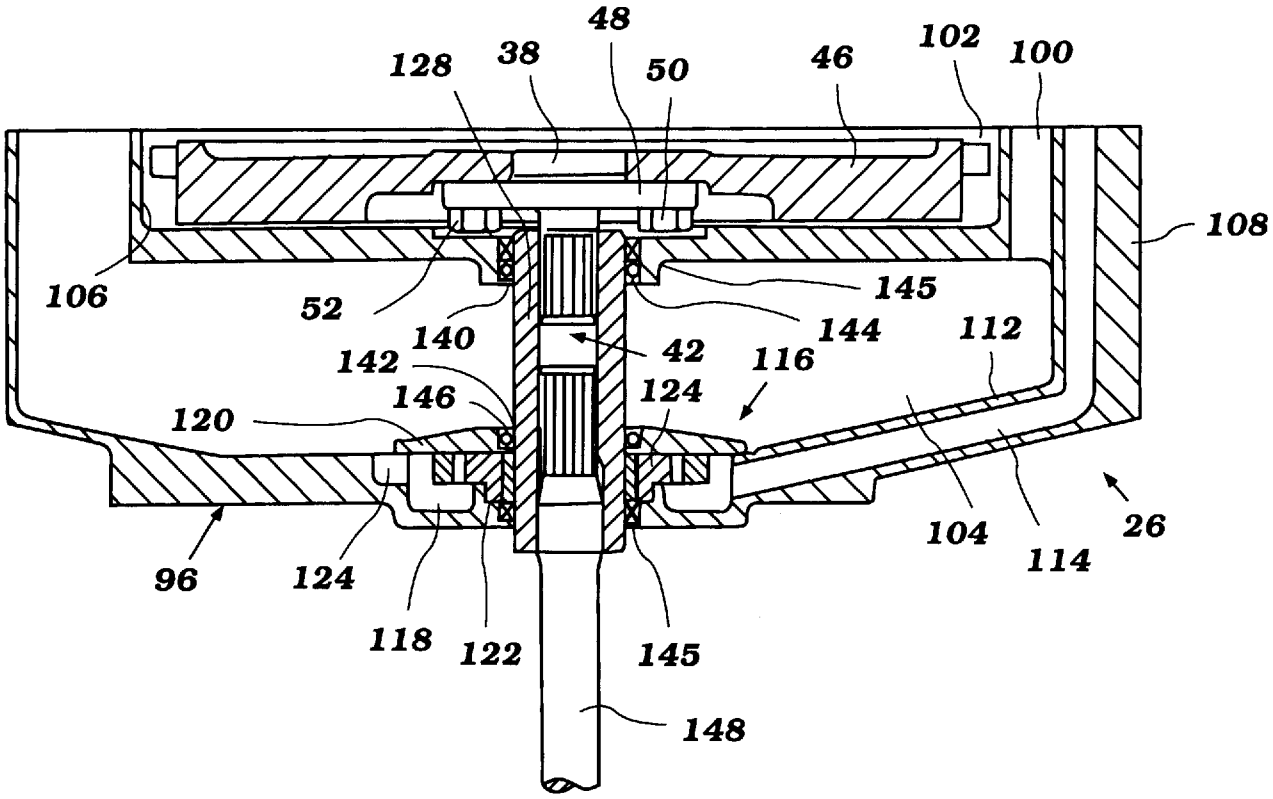
FIG. 4 is an enlarged cross-sectional view of the oil pump of the present invention.

The oil pump 26 includes an oil pan 96 connected to the engine block 28. As best illustrated in FIG. 4, the oil pan 96 has a generally cylindrical shape defined by an outer wall 108. The oil pan 96 has one generally open end for positioning against the engine block 28, and an enclosed side and bottom.

Within the outer wall 108 is defined a first area 102 and a second area 104. The first area 102 comprises a recess which is circular in shape, having a depth and circumference to accommodate the flywheel 46. The first area 102 is defined by an inner wall 106. The inner wall 106 and an outside surface of the engine block 28 cooperate to form an enclosure or closed chamber about the flywheel 46 when the pan 96 is mounted to the block 28.

The second area 104 serves as an oil chamber or sump, and as such is adapted for retaining lubricating oil. The second area 104 generally comprises that space defined between the inner and outer walls 106,108. When the pan 96 is mounted to the engine block 28, a first oil return passage 94a leading from the crankshaft area is in communication with the second area 104. Further, a second oil return passage 94b of the engine 22 communicates with the second area 104 via a passage or line 110 extending between the inner wall 106 and a third wall 112 spaced slightly from outer wall 108.

The oil pump 26 includes a means for pumping oil from the second area 104 to the engine 22. Preferably, this means comprises a pump element 116 mounted within a generally cylindrical cavity or pumping chamber 118 of the oil pan 96. The pumping chamber 118 is preferably defined by the outer wall 108 of the pan 96 as a recessed portion or extension of the second area 104.

The pump element 116 is preferably of that type known as a "trochoidal" or "rotor"-type pump. This type of pump element 116 has a driven inner cross-shaped rotor 122. The inner cross-shaped rotor 122 is positioned within a larger star-shaped (i.e. five point) chamber of an outer rotor 124 having a cylindrical outer surface. As is well known to those skilled in the art, the inner rotor 122 rotates within the chamber of the outer rotor 124, while at the same time driving the outer rotor 124. The axis of rotation of these two rotors 122,124 is offset, however, whereby the space between the inner rotor and the chamber of the outer rotor varies in size, forcing oil from one side to the other.

Preferably, a disc-shaped element 120 is positioned over the pumping elements 116. The disc 120 has a circumference which extends beyond the periphery of the pumping chamber 118. The disc 120 effectively separates the pumping chamber 118 from the remainder of the second area 104.

The pumping chamber 118 is designed to cooperate with the pumping means. In the arrangement described above, the pumping element 116 (i.e. in the preferred embodiment the outer rotor 124 housing the inner rotor 122) fits within the pumping chamber 118 with that portion of the outer wall 108 defining the pumping chamber acting as a pump housing for the pumping element 116.

An oil feed inlet 124 is provided from the second area 104 to the pumping chamber 118. The inlet 124 comprises a recessed area in the outer wall 108. The inlet 124 extends from slightly beyond the outer periphery of the top portion 120 of the pumping element 116 downwardly and inwardly in communication with the pumping chamber 118.

An oil outlet passage 114 extends between the pumping chamber 118 and the end of the pan 96 adapted for mounting to the engine block 28, whereby the passage 114 is in communication with an oil inlet passage 94c leading into the engine 22. Preferably, this passage 114 comprises a space between said third wall 112 and the outer wall 108. The pumping element 116 is arranged to move oil from the inlet 124 to the oil outlet passage 114.

Means are provided for driving the pumping element 116. Preferably, this means comprises the output shaft driven by the engine 22. In the present invention, the output shaft drives not only the propeller of the outboard motor 22, but also the pumping element 116 of the oil pump 26. As best illustrated in FIGS. 1 and 4 and as described above, the output shaft driven by the engine 22 preferably comprises the crankshaft 38 of the engine 22 coupled to the drive shaft 148 by a sleeve 128. The output shaft extends through the second area 104 or "oil sump" and the pumping chamber 118.

In particular, the second end 42 of the crankshaft 38 extends outwardly of the second end of the engine 22 and beyond the mounting flange 48 for the flywheel 46. This end 42 of the crankshaft 38 is splined. The coupling sleeve 128 engages the splined second end 42 of the crankshaft 38. The sleeve 128 has a first end positioned within a bore 140 through the inner wall 106 of the pan 96. A second end of the sleeve 128 extends beyond the pan 96 through a bore 142 in the outer wall 108 ofthe pan 96.

The first end of the sleeve 128 is journalled for rotation within the bore 140 and with respect to the wall 106 via a bearing. Similarly, the second end of the sleeve 128 is journalled for rotation within the bore 144 with respect to the outer wall 108 via a bearing 146. Appropriate seals 145 are provided for preventing fluid leakage from the second area 104 to the first area 102, or from the second area 104 along the engine block 28 or along the sleeve 128 therefrom.

The inner rotor 122 of the pumping element 116 is securely mounted to the output shaft, and more particularly to the outside of the sleeve 128, in the oil pan 96 described above. As a result, when the crankshaft 38 turns, the sleeve 128 turns the inner rotor 122 (and, as described above, the outer rotor 124 in which it is positioned).

The drive shaft 148 extends outwardly from the second end of the sleeve 128 opposite the crankshaft 38. The drive shaft 148 has a splined first end which is positioned within the sleeve 128 and spaced apart from the end of the crankshaft 38. The drive shaft 148 extends downwardly from the sleeve 128 to drive a propulsion unit (not shown).

Use of the oil pump 26 of the present invention with an engine 22 and its advantages are as follows. The oil pan 96 is connected to the engine block 28 in the orientation illustrated in FIG. 1. So connected, the inner wall 106 cooperates with the end of the engine block 28 to form a chamber or enclosure which houses the flywheel 46.

Lubricating oil is provided to the system through an appropriate fill hole. Oil drains through the lubricating oil passages 94 within the engine 22. The oil ultimately flows through the oil passages 94*a,b* to the sump or second area 104 of the oil pan 96. When the engine 22 is running, the crankshaft 38 turns. When the crankshaft 38 turns, so do the sleeve 128 and the pumping element 116 connected thereto. The pumping element 116 draws oil from the second area 104 through the feed passage 124 into the pumping chamber 118. At the same time, the pumping element 116 delivers oil from the pumping chamber 118 to the outlet passage 114. This oil flows up the outlet passage 114 and into the inlet passage 94*c* to the engine 22, where the oil is routed through the many oil passages 94 in the engine for lubricating its parts as disclosed above.

Advantageously, the oil sump for the pump 26 of the present invention is positioned close to the engine 22. The oil pan 96 is designed such that the lowest point of the oil sump (i.e., second area 104) is a minimal distance below the engine 22. As a result, the power needed to pump the oil is greatly lessened. In addition, the oil pump 26 of the present invention is powered by the output of the engine 22 in direct fashion, without the need for belt or chain drives or the like. The oil pump 26 of the present invention also has the advantage of being readily serviceable. When the pan 96 is disconnected from the end of the engine block 28, the pumping element 116 is exposed for servicing or replacement.

Further, the wall of the oil pan serves not only to define an oil reservoir or chamber, but acts as the housing for the pumping element, thereby serving as a pump housing at the same time.

When the oil pump 26 is used on an engine 22 of a motor 20 utilized to power a boat, the positioning of the pan 96 at the lower portion of the engine 22 has the advantage that changes in motor trim angle have little effect upon the ability of the oil pump to supply oil to the engine. This is true notwithstanding the fact that the oil pan 96 is rather shallow, since as the pan 96 is near the motor's swivel point when positioned below the engine 22, changes in motor trim angle do not greatly shift the oil in the pan 96 to one side thereof It will be understood that the above-described arrangements of apparatus and the method therefrom are merely illustrative of applications of the principles of this invention and many other embodiments and modifications may be made without departing from the spirit and scope of the invention as defined in the claims.

What is claimed is:

1. In combination, an engine and a lubricating oil pump, the engine comprising a block and an output shaft journalled for rotation with respect to said block and having a first end extending outwardly of said block, said oil pump comprising an oil pan connected to said block, said oil pan comprising an outer housing defining therein an oil chamber and a pumping chamber, and means for pumping oil from said pumping chamber to said engine, said means for pumping positioned in said chamber, wherein said output shaft of said engine extends through said oil chamber and pumping chamber of said oil pan, and wherein said engine includes a flywheel mounted on said output shaft and said oil pan includes an inner wall positioned within said outer housing, said inner wall defining a recess in which said flywheel is positioned.

2. The combination in accordance with claim 1, wherein said means for pumping comprises a rotatable pumping element.

3. The combination in accordance with claim 2, wherein said pumping element has a first section for dividing said pumping chamber and said oil chamber, and a second portion positioned in said pumping chamber for cooperation therewith in pumping oil from said pumping chamber to said engine.

4. The combination in accordance with claim 1, wherein said means for pumping is mounted to said output shaft of said engine and driven thereby.

5. The combination in accordance with claim 1, further including an outlet passage extending from said pumping chamber to an oil inlet passage of said engine, said means for pumping delivering oil to said engine from said oil chamber through said outlet passage.

6. The combination in accordance with claim 1, wherein said output shaft comprises a crankshaft of said engine and a drive shaft coupled to said crankshaft, said crankshaft extending into said oil pan and connected to said drive shaft therein and said drive shaft extending outwardly of said oil pan.

7. The combination in accordance with claim 6, wherein said crankshaft and drive shaft are connected by a sleeve.

8. The combination in accordance with claim 1, wherein said oil pan includes at least one oil inlet for said oil chamber, said oil inlet in communication with an oil outlet of said engine.

9. In combination, an engine positioned within an outboard motor housing of an outboard motor and having a propulsion device for propelling an associated watercraft, said engine having an oil pump for providing lubricating oil to said engine, said engine having a block and an output shaft extending therefrom and coupled to said propulsion device for driving said propulsion device, the engine oriented such that its output shaft extends generally vertically, wherein said pump comprises an oil pan positioned beneath said engine, said oil pan comprising an outer housing defining an oil chamber and a pumping chamber therein, and means for pumping positioned in said pumping chamber for pumping oil therefrom to said engine, wherein said output shaft of said engine extends through said oil and pumping chambers, and wherein said engine includes a flywheel positioned on said output shaft, and said outer housing of said oil pan further defines a recessed area for acceptance of said flvwheel therein.

10. The combination in accordance with claim 9, wherein said pumping chamber comprises a recessed area defined by said outer housing, said pumping chamber in communication with said oil chamber.

11. The combination in accordance with claim 9, wherein said pumping chamber is generally cylindrical in shape and said means for pumping comprises an element rotatably positioned within said pumping chamber.

12. The combination in accordance with claim 11, wherein said element is mounted to said output shaft for rotation thereby.

13. The combination in accordance with claim 10, wherein said oil pan is mounted to said engine, said outer housing includes an inner wall for defining said recessed area, and wherein said recessed area is positioned between said engine and said oil chamber.

14. The combination in accordance with claim 9, wherein said outer housing of said oil pan serves as a pump housing for said means for pumping.

* * * * *